US005669872A

United States Patent [19]

Fox

[11] Patent Number: 5,669,872

[45] Date of Patent: Sep. 23, 1997

[54] METHOD FOR FOCUSED DELIVERY OF VENOUS FLOW FOR ARTIFICIAL IMPLUSE COMPRESSION OF AN ANATOMICAL FOOT PUMP

[75] Inventor: Roger Harrington Fox, Torquay, England

[73] Assignee: Novamedix Limited, Andover, England

[21] Appl. No.: 398,853

[22] Filed: Mar. 6, 1995

Related U.S. Application Data

[63] Continuation of Ser. No. 156,319, Nov. 22, 1993, abandoned, which is a continuation-in-part of Ser. No. 980,580, Nov. 23, 1992, abandoned.

[51] Int. Cl.[6] ..... A61H 7/00

[52] U.S. Cl. ..... 601/152; 128/898

[58] Field of Search ..... 601/198, 149, 601/150, 151, 152; 128/898, DIG. 20

[56] References Cited

U.S. PATENT DOCUMENTS

| | | | |
|---|---|---|---|
| 3,853,121 | 12/1974 | Mizrachy | 601/48 |
| 4,370,975 | 2/1983 | Wright . | |
| 4,702,232 | 10/1987 | Gardner et al. | 601/152 |
| 4,841,956 | 6/1989 | Gardner | 601/152 |
| 4,941,458 | 7/1990 | Taheri . | |
| 4,947,834 | 8/1990 | Kartheus et al. . | |
| 5,186,163 | 2/1993 | Dye | 601/27 |
| 5,368,034 | 11/1994 | Isner | 128/660.03 |
| 5,584,798 | 12/1996 | Fox . | |

FOREIGN PATENT DOCUMENTS

| | | | |
|---|---|---|---|
| 650992 | 5/1993 | Australia | 601/152 |

OTHER PUBLICATIONS

Becker, Daniel M. et al "Inferior Vena Cava Filters" Arch Intern Med, vol. 152 Oct. 1992.

*Primary Examiner*—Michael A. Brown
*Assistant Examiner*—Benjamin Koo
*Attorney, Agent, or Firm*—Hopgood, Calimafde, Kalil & Judlowe

[57] ABSTRACT

A method for therapeutically or prophylactically treating a diagnosed or potential deep-vein thrombosis involves intermittent application of tourniquet action to the leg at a location preferably close to the ankle, i.e., at the distal-calf region of the leg, in time-coordinated relation to artificially stimulated foot-pump action; the level of tourniquet action is such as to reduce the availability of superficial veins to carry the venous-return flow that is stimulated by foot-pump action, and the level of tourniquet action is also insufficient to materially affect access to deep-veins which are the primary target of therapeutic or prophylactic treatment.

In a modification, the sequencing of tourniquet and foot-pump action is changed to enhance the priming of blood in the plantar veins of a foot which must remain elevated above the heart level of a patient confined to bed, whereby circulation can be more effectively stimulated by foot-pump action.

55 Claims, 5 Drawing Sheets

TIME
TIME
TIME
TIME
Δ
135
135'
134
CYCLE
$P_P$
PC1
PC2
PC3

METHOD FOR FOCUSED DELIVERY OF VENOUS FLOW FOR ARTIFICIAL IMPLUSE COMPRESSION OF AN ANATOMICAL FOOT PUMP

RELATED CASE

This is a continuation of application Ser. No. 08/156,319, filed Nov. 22, 1993, which in turn is a continuation-in-part of Ser. No. 07/980/580, filed Nov. 23, 1992, both abandoned.

BACKGROUND OF THE INVENTION

The invention, as originally conceived, pertains to a method and means for therapeutically and/or prophylactically dealing with a thrombotic or with a potentially thrombotic condition in a human limb, particularly in a leg. Such thrombotic conditions generally occur in the deep veins, hence, the term deep-vein thrombosis, herein abbreviated to DVT.

The literature[1] is beginning to accumulate important evidence of the successful use of a so-called foot pump in reducing the chances of thrombo-embolism, following surgery wherein a blood clot in the venous system may otherwise have proven fatal. By foot-pump use is meant methods and means as disclosed and discussed in U.S. Pat. Nos. Re. 32,939, Re. 32,940, 4,696,289, and 4,721,101. In the present specification, the disclosures of these patents are incorporated by reference.

[1] See, for example, Stranks/MacKenzie/Grover/Fail, "The A-V Impulse System Reduces Deep-Vein Thrombosis and Swelling after Hemiarthroplasty for Hip Fracture"; Journal of Bone Joint Surgery (British), Vol. 74-B, No. 5, Sep. 1992, pp. 775–778, including references cited therein; and see also Bradley/Krugener/Jager, "The Effectiveness of Intermittent Plantar Venous Compression in Prevention of Deep Venous Thrombosis after Total Hip Arthroplasty", The Journal of Arthroplasty, Vol. 8, No. 1, 1993.

It suffices for present purposes to state that a foot-pump appliance of the character indicated makes use of a Gardner/Fox discovery reported in 1983 ("The Venous Pump of the Human Foot—Preliminary Report", Bristol Medico-Chirurgical Journal; Gardner and Fox; pp. 109–112; July 1983), namely that plantar veins of the foot provide a pool of blood for return via the venous system, and that in unafflicted persons, the transfer of weight-bearing from one to the other foot in the course of walking entails a transient stretching of plantar veins and thus a transient shrinking of plantar-vein capacity, such as to drive venous flow back to the heart via the check-valve action of the veins. Significantly, no muscular action is involved in this venous-return flow. The foot-pump disclosures of said patents provide the patient who is bed-ridden or otherwise unable to walk with a mechanical substitute for the intermittent weight-bearing action available to ambulatory individuals. The mechanical substitute involves periodic application of a relatively short pulse of compression against the underside of the foot, between the ball and the heel of the foot, to a degree sufficient to transiently reduce the volume of the plantar veins, thus driving an increment of venous return flow back to the heart, primarily via the deep veins of the leg.

In the circumstance of using the mechanical foot pump to deal with a thrombotic condition in the leg, the deep veins will have been partially or wholly blocked by a developing or a developed clot accumulation, so that deep-vein resistance to stimulated flow compels superficial veins to assume an abnormal flow, for each foot-pump stimulation. This can be the source of increased pain and may result in a long-term abnormal reliance upon the superficial veins. Moreover, in the event that a thrombolitic agent, such as streptokinase, has been introduced into the circulatory system for purposes of dissolving the clotted condition, any diversion of venous-return flow to superficial veins is a by-passing of the deep-vein target of therapy; this can be interpreted to mean that an unnecessarily great proportion of thrombolitic agent must be introduced or that the time of therapeutic treatment may be longer than necessary, were it possible to more effectively focus delivery of the thrombolitic agent at the deep-vein situs of thrombosis.

BRIEF STATEMENT OF THE INVENTION

It is an overall object of the invention to provide improved methods and means for dealing with a blood-circulatory abnormality in a human leg.

It is a specific object of the invention to provide an improved method and means for therapeutically and/or prophylactically dealing with a deep-vein thrombosis (DVT) condition in a leg.

Another specific object is to provide an improved method and means for directing foot-pump stimulated venous-return flow, with emphasis on deep-vein conduct of such flow.

Still another specific object is to provide means to achieve the foregoing objects, with selectively available further applicability to improvement of venous and arterial flow for a patient who is confined to bed with a leg elevated above his body.

A further object is to achieve the above objects while also achieving an enhancement of arterial flow in the same leg.

It is also an object to achieve the foregoing objects without impairing arterial flow.

A general object is to achieve the above-stated objects with apparatus of relative simplicity and offering a range of options to operating medical personnel, both for accommodation to the differing symptoms and tolerances of successive patients, and for accommodation to the changing symptoms and tolerances of a given patient in the course of administering a therapeutic treatment to the patient.

The invention achieves the foregoing objects by providing an intermittently applied tourniquet action to the leg at a location preferably close to the ankle (i.e., to the distal calf), in time-coordinated relation to foot-pump action, wherein the level of tourniquet action is such as to reduce the availability of superficial veins to carry the venous-return flow that is stimulated by foot-pump action, and the level of tourniquet action is also insufficient to materially affect access to deep veins which are the primary target of therapeutic or prophylactic treatment.

BRIEF DESCRIPTION OF THE DRAWINGS

The invention will be described in detail in conjunction with the accompanying drawings, in which.

DETAILED DESCRIPTION OF THE INVENTION

Figure 1:
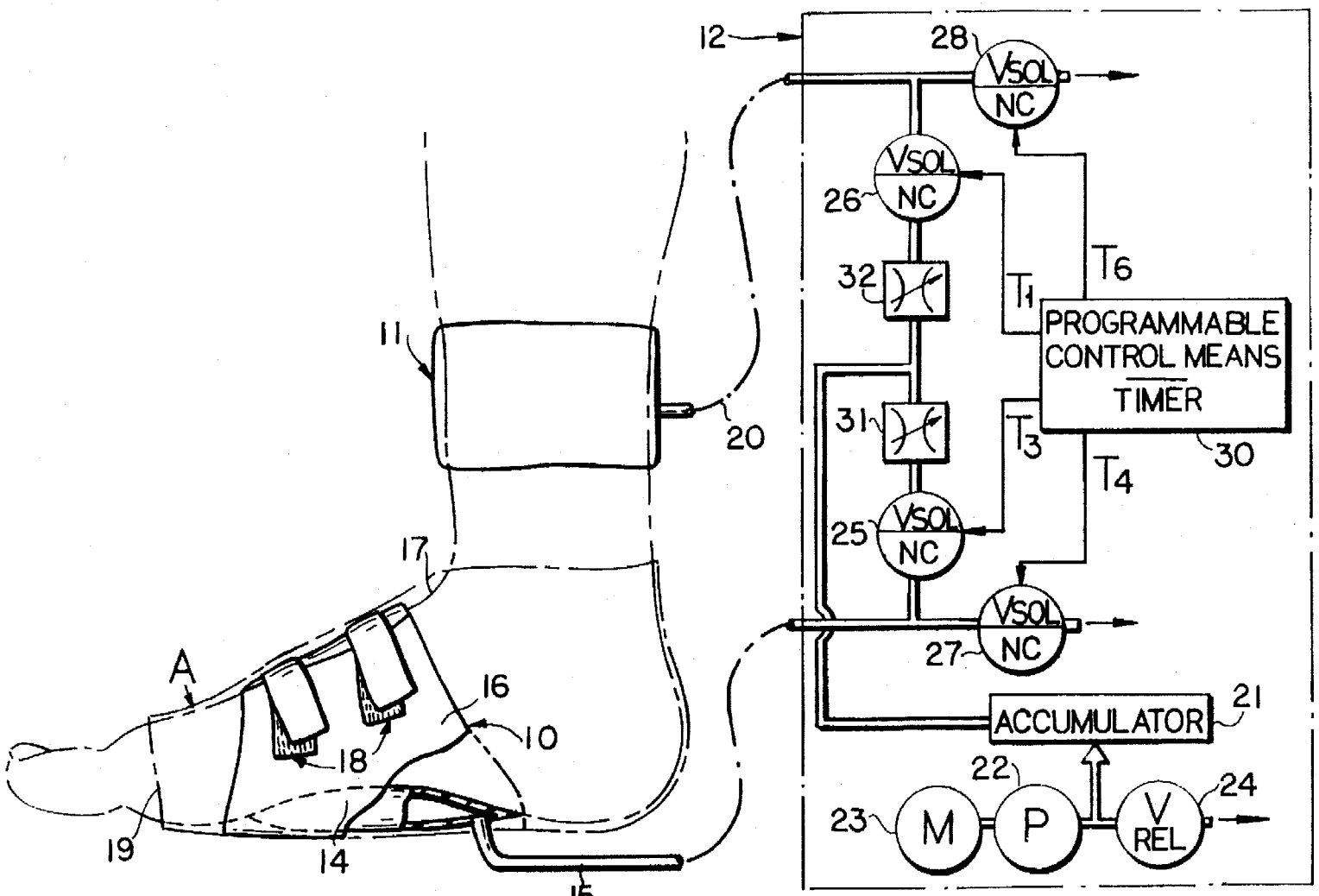
FIG. 1 is a simplified side view of an appliance of the invention, partly broken away and in installed position on a human leg, with a schematic diagram of interrelated components for operation pursuant to a presently preferred mode.

With initial reference to FIG. 1, the invention is shown in application to the foot and distal calf of a human leg, wherein a foot-pump element 10 is applied to the foot, a tourniquet-calf element 11 is applied to the distal calf, and pneumatic actuating and control means 12 is connected to elements 10 and 11 for coordinated operation of the same, pursuant to a repetitive cycle, which may be within the range 15 to 60 seconds.

The foot-pump element 10 is suitably as described in said patents, so that simplified identification of parts will suffice for present purposes. As shown, the foot-pump element 10 comprises an inflatable bag or bladder 14 shaped for engagement with the sole of the foot and in the plantar arch, namely between the ball and the heel of the foot. A flexible pipe 15 connects bag 14 to the pneumatic supply and control means 12. The foot-pump element 10 further comprises a suitably padded wrap 16, embracing the bag 14 and over the instep 17 of the foot, and secured as by hook and loop fastening elements 18, to complete a circumferential tie at and around the mid-tarsal joint. The wrap 16 is shown covered by a cloth slipper 19 which covers the majority of the foot, leaving the toes exposed for the physician's inspection and reaction-testing of the involved foot. In use, apparatus to be described at 12 operates rapidly to inflate the bag 14, which reacts against the circumferentially tied wrap 16 to apply pumping pressure to the sole of the foot while also urging the ball and heel of the foot away from each other, thus applying upward and spreading force and transiently flattening the plantar arch, as would occur if the foot were placed on the ground (i.e., body-weight bearing) during normal ambulation, thereby stimulating venous blood flow.

The tourniquet-cuff element 11 may be a commercially available inflatable item, providing a circumferential tie around an inflatable bladder (not shown) which is preferably applied to the distal-calf region; the only exposed part of the inflatable cuff element 11 is its flexible supply pipe 20, which receives its inflation/deflation air supply from the control means 12.

The pneumatic actuating and control means 12 of FIG. 1 operates from an accumulator 21 of pressurized air, which in the case of certain hospitals may be provided by a central source of suitably pressure-regulated supply. However, as shown, self-contained means 12 comprises an air pump 22, motor-driven at 23, with a relief valve 24 to determine a suitable upper limit of air pressure at accumulator 21. Pressurized air from the accumulator is connected for inflation-air delivery to the foot-pump supply pipe 15, via a first solenoid-operated valve 25 of the normally closed (NC) variety, and for inflation-air delivery to the tourniquet-cuff supply pipe 20, via a second normally closed solenoid-operated valve 26. Third and fourth normally closed solenoid-operated valves 27, 28 are respectively connected to the foot-pump and cuff pipes 15, 20 for controlled discharge to ambient air of the respective inflatable elements 10, 11. Programmable control means 30 will be understood to be presettable for the sequentially and suitably timed operation of the respective solenoid-operated valves, thus determining particular valve-opening events, suggested by time legends $T_1$, $T_3$, $T_4$, $T_6$ which will be discussed in connection with the adjacent graphs of FIGS. 2A and 2B to the same time scale.

Figure 2A:
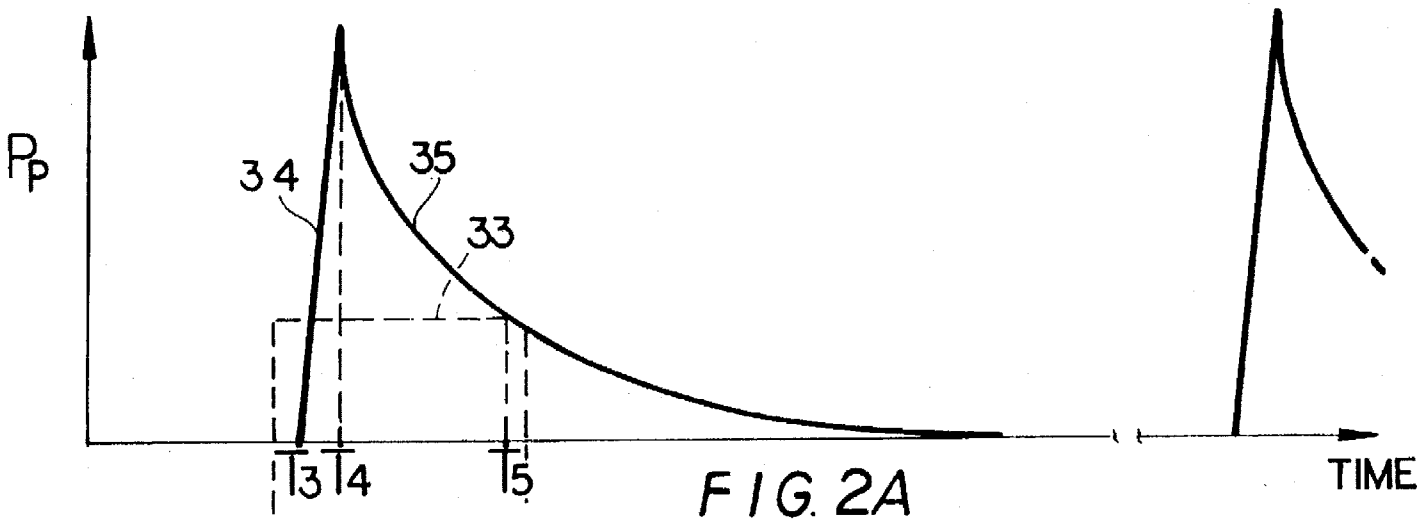
FIG. 2A is a graphical illustration of pressure as a function of time, for operation of a foot-pump portion of the appliance of FIG. 1.
Figure 2B:
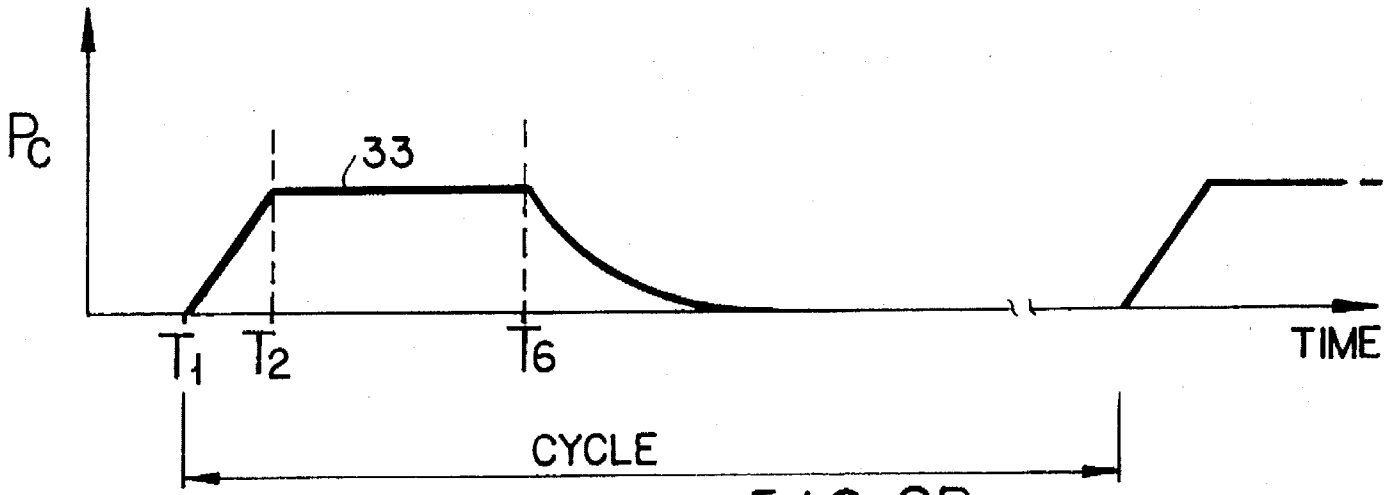
FIG. 2B is a graphical illustration of pressure as a function of time, for operation of a tourniquet-cuff portion of the appliance of FIG. 1, the illustrations of FIGS. 2A and 2B being exaggerated and juxtaposed for better illustration of time-coordinated functions of the appliance.

The graph of FIG. 2A displays, with some exaggeration for clarity, a representative inflation/deflation pressure pulse for the foot-pump element 10, and the graph of FIG. 2B is a similar display for a representative inflation/deflation pressure pulse for the tourniquet-cuff element 11. Separately identified times $T_1, T_2, \ldots T_6$ within each cycle of appliance operation serve to mark various coordinating events, as between foot-pump and tourniquet operation in the cycle, and the use of time designations $T_1$ to $T_6$ will be understood to indicate initiation of solenoid-valve actuations by means 30 in FIG. 1. Also, separately adjustable variable orifices 31, 32 in the respective inflation lines to the foot-pump and cuff elements 10 and 11 will be understood to provide selective control of inflation rates for these elements.

As seen in FIG. 2B, a representative cycle of appliance operation will commence with an actuating signal from control means 30 at time $T_1$, thus opening valve 26 and initiating inflation of cuff 11. The flow of inflation air from accumulator 21 will preferably have been adjusted at 32 to provide a relatively slow rate of cuff inflation, so that, based on operational experience with the pressure of air from accumulator 21, an event $T_2$ determined by the program of means 30 will terminate the supply of accumulator air to cuff 11, by terminating the excitation of valve 26, thereby allowing valve 26 to return to its normally closed condition, with cuff 11 temporarily locked in inflated condition, at a level 33 of cuff pressure $P_c$ which will have been selected for the desired degree of local primary flow-restriction action on superficial veins, with relatively little flow-restricting action on deep veins. Suitably and illustratively, this level of cuff-inflation pressure is in the range of 30 to 100-mm Hg, being preferably in the range of 40 to 60-mm Hg; and the rate of cuff inflation is relatively slow, with cuff inflation accomplished within no less than one second.

At a time $T_3$ which may be determined by control means 30 to be at or soon after time $T_2$, the solenoid valve 25 is actuated to open condition, thus admitting inflation air from accumulator 21 to the foot-pump bag, pursuant to the rate of air supply selected by prior adjustment of orifice 31. The rising slope 34 of inflation air to a peak foot-pump pressure in excess of the transiently locked-inflation pressure 33 of cuff 11 is desirably relatively rapid and in the range up to one second, being preferably in the range of 0.5 second or less. Achievement of peak foot-pump inflation pressure may be signalled by a pre-set pressure sensitive switch for terminating the actuating signal to solenoid valve 25, but in the circuitry shown in FIG. 1, a peak-timing event at $T_4$ is operative (a) to terminate the actuating signal to valve 25 and (b) to initiate actuation of solenoid valve 27, for discharge of inflation air from foot-pump element 10, thus deflating the foot-pump bag 14 as rapidly as possible and substantially immediately upon achievement of peak foot-pump pressure. In FIG. 2A, the curve 35 of resulting relief of foot-pump pressure has been exaggerated to enable better identification of subsequent events in the illustrative cycle of appliance operation. Experience in appliance operation will establish awareness that, at a particular time $T_5$ (related to a selected peak of foot-pump pressure), the curve 35 of deflating pressure will cross and reduce below the locked cuff-inflation level 33, and therefore, based on this experience, the control means 30 will have been set to issue a valve-opening signal $T_6$ to the cuff-deflating solenoid valve 28.

Figure 3A:
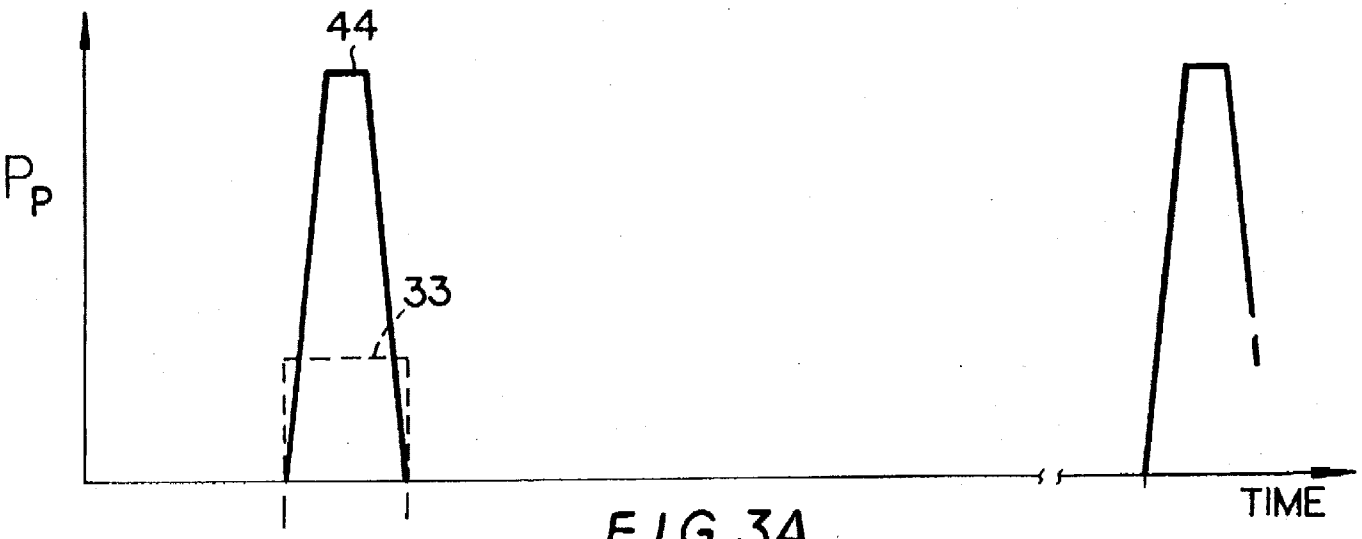
FIG. 3A is a simplified graphical illustration of foot-pump pressure as a function of time for a modified mode of operation of the invention.
Figure 3B:
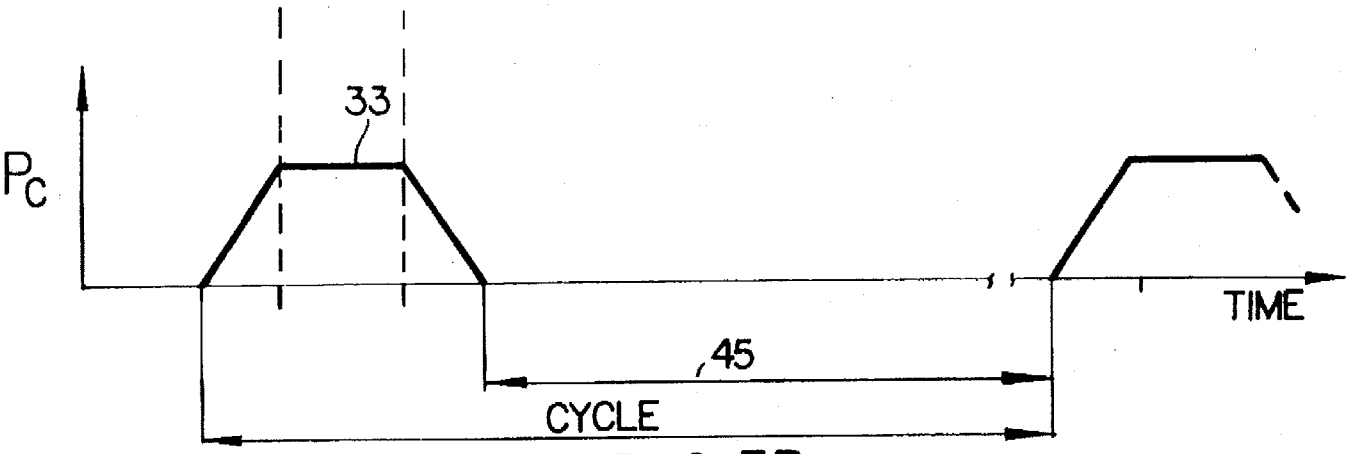
FIG. 3B is a simplified graphical illustration of tourniquet-cuff pressure as a function of time, the illustrations of FIGS. 3A and 3B being juxtaposed for better illustration of coordinated functions of the modified mode.
Figure 4:
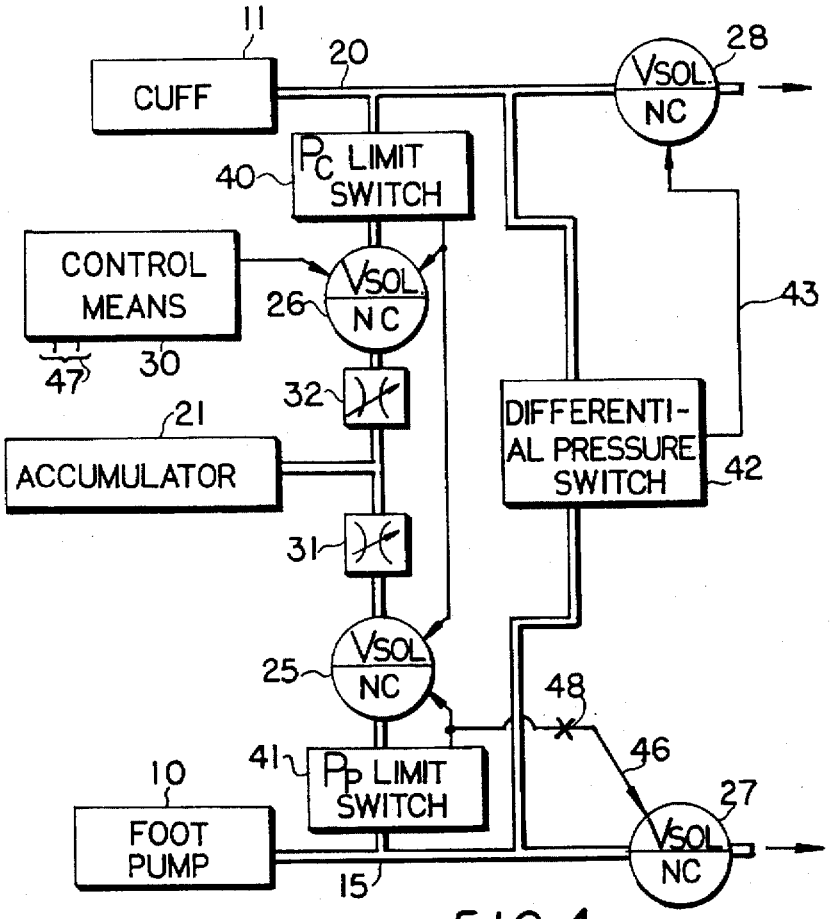
FIG. 4 is a schematic diagram of interrelated components for operation pursuant to the modified mode of FIGS. 3A and 3B.

FIGS. 3A, 3B and 4 illustrate a modification wherein sensed pressure thresholds determine key events in the operative sequence of cuff and foot-pump actuation in each cycle. Pneumatic circuitry remains substantially as already described for FIGS. 1, 2A and 2B, and therefore the same reference numbers are used, where applicable. Threshold sensing of a predetermined limit of cuff-inflation pressure is provided by pressure-sensitive switch means 40 in the air-supply line from solenoid valve 26 to cuff 11, and threshold sensing of a predetermined peaking limit of foot-pump pressure is provided by pressure-sensitive switch means 41 in the air-supply line from solenoid valve 25 to foot-pump 10. And a differential-pressure switch 42 is connected for differential response to instantaneous cuff and foot-pump pressures, such that switch 42 may produce an electrical output signal in line 43 to solenoid valve 27 when foot-pump pressure has been sensed to drop to or below cuff-inflation pressure.

Each pulsing cycle of FIGS. 3A, 3B and 4 commences with an electrical actuating signal from control means 30 to solenoid valve 26, thus opening valve 26 and admitting inflation air to cuff 11 at a relatively slow rate determined by pre-set adjustment of orifice 32. Achievement of cuff inflation to the limit 33, predetermined at 40, will activate switch 40 (a) to terminate the actuated open condition of solenoid valve 26, and (b) to actuate solenoid valve 25 to open condition. Valve 25 then admits inflation air to foot-pump 10, at a relatively fast rate determined by pre-set adjustment of orifice 31. Achievement of peak foot-pump inflation pressure to a limit 44 pre-set at 41 (above cuff limit 33) will activate switch 41 (a) to terminate the actuated open condition of solenoid valve 25, and (b) to actuate solenoid valve 27 (via line 46) to open condition, thus initiating deflation of the foot-pump. Then, when the differential-pressure switch 42 has sensed foot-pump deflation to the level of inflated-cuff pressure, switch 42 is operative to deflate cuff 11. A predominant fraction 45 of the cycle period remains inactive, with both elements 10, 11 deflated, or substantially deflated, until control means 30 calls for recycled operation of inflation events, by again actuating solenoid valve 26 to open condition.

The described operation of FIG. 4 will be seen to involve foot-pump deflation as soon as possible, once the peak-inflation level has been sensed by switch means 41. That being the case, the circuit of FIG. 4 can produce substantially the same coordination of cuff inflation and foot-pump inflation as was the case described in connection with FIG. 1. In certain situations, however, it may be desired to provide a selected relatively short period of holding the peak of foot-pump inflation pressure, before initiating the deflation process. It should be clear that such retention of foot-pump inflation in the case of FIG. 1 is achievable, merely by preselecting, at control means 30, a suitable interval between times $T_3$ and $T_4$, for example, a selected interval of 1 to 5 seconds. In the case of FIG. 4, a preselected peak-holding period of similar nature is selectively available by placing preselected timer terminals 47 (of control means 30) in series with a break in line 46, wherein such a break for series connection to terminals 47 is suggested by an "x" mark 48.

Use of the described appliance, whether by way of pre-set timing as in FIG. 1 or by way of sensed pressure levels as in FIG. 4, will be seen to achieve stated objects and to be pursuant to the following criteria for each cycle:

(a) A first level (33) of transient tourniquet pressure is applied to the leg; in the case of a diagnosed or suspected possible DVT condition or development, it is preferred that cuff 11 be applied at the distal-calf region, which for most cases will be distal to the DVT condition. And even if the DVT condition extends to the distal calf, the preferred distal-cuff application of cuff 11 is recommended.

(b) Transient venous-pumping pressure is then applied to the plantar region of the foot, at a relatively rapid rate and to a peaking level which exceeds that of the tourniquet action at the cuff; the cuff will thus have reduced the availability of superficial veins to accommodate pumped venous flow, so that deep veins may be targeted with enhanced effect. If a thrombolitic agent is introduced at the dorsum of the foot, as at location A in FIG. 1 (e.g., through a local opening in slipper 19), then direct plantar-vein acceptance of the thrombolitic agent can occur, and the existence of tourniquet-cuff action will necessarily mean delivery of the thrombolitic agent to the deep veins with enhanced efficiency and DVT-dissolving effect.

(c) The venous-pumping pressure may be relieved immediately or following a short peak-holding period, at the option of the physician who may have preferred to provide a measure of concurrent enhanced arterial flow to the leg, pursuant to the teaching of U.S. Pat. No. 4,721,101. Whatever the selected time for retention of peak venous-pump pressure, the holding time is short compared to the cycle time, so that in no case is arterial flow impaired.

(d) The tourniquet pressure is relieved once the venous pressure has reduced to or below the level of transiently applied tourniquet pressure. Even with a preferred relatively slow rate of tourniquet-pressure development, the period of tourniquet-pressure application is short relative to the indicated range of cycle duration, so that arterial flow remains unimpaired if not enhanced.

Quite aside from the described DVT-treating uses and features, the invention is also seen to have further application for the bed-ridden patient for whom the orthopedic surgeon may have ordered a foot to be suspended in elevated relation with respect to the heart. In that situation, the plantar veins will necessarily be above heart elevation, thus inviting slow gravitational drainage of plantar veins and preventing such plantar-vein accumulation of blood as could be the subject of artificial foot-pump actuation. To avoid such drainage and at the same time to provide a means of plantar-vein accumulation of blood for foot-pumped venous-return flow, the cuff 11, particularly when located at the distal calf and inflated to the already indicated pressure range, and for the relatively long period up to 10 seconds, or for a period of at least 10 seconds prior to foot-pump actuation, will permit a desirable volume of plantar-vein accumulation by the time the foot-pump is activated at the rate and to the peak-pressure range already discussed. Of course, on discharge of foot-pump inflation, the cuff 11 should also be deflated, until need for renewed cuff inflation for the next cycle of coordinated cuff and foot-pump actuation.

Figure 5:
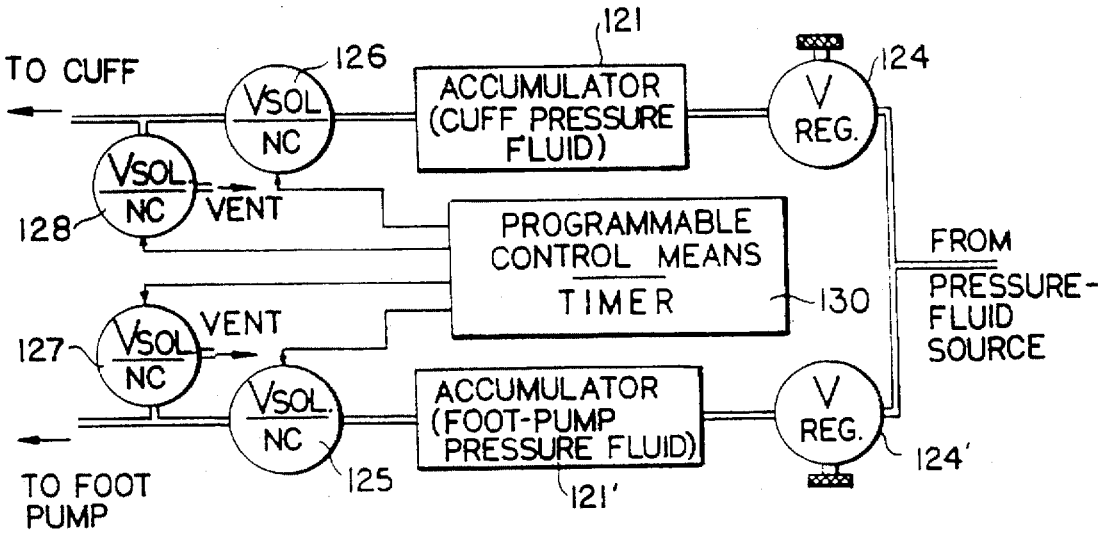
FIG. 5 is another schematic diagram of interrelated components for selective control as to mode of operation.

FIG. 5 provides further schematic illustration of appliance components capable of various selected operations of cuff 11 in timed relation to foot-pump (14) operation, wherein programmable control means 130 is seen to determine the sequencing and/or interlacing of events governed by four solenoid valves, 125, 126, 127, 128, which may be of normally closed variety, as suggested by the symbol NC, it being understood that in FIG. 5 such flow-control devices as suitably adjusted variable orifices in the respective lines for these solenoid valves have been omitted, for simplification of the drawing. As shown in FIG. 5, separate regulator valves 124, 124' operate from a single pressure-fluid source and are selectively adjustable to determine, respectively, a first and relatively low regulated pressure available for cuff inflation from a first accumulator 121, and a second and relatively elevated regulated pressure available for foot-pump inflation from a second accumulator 121'.

Figures 6A, 6B, 6C, 6D:
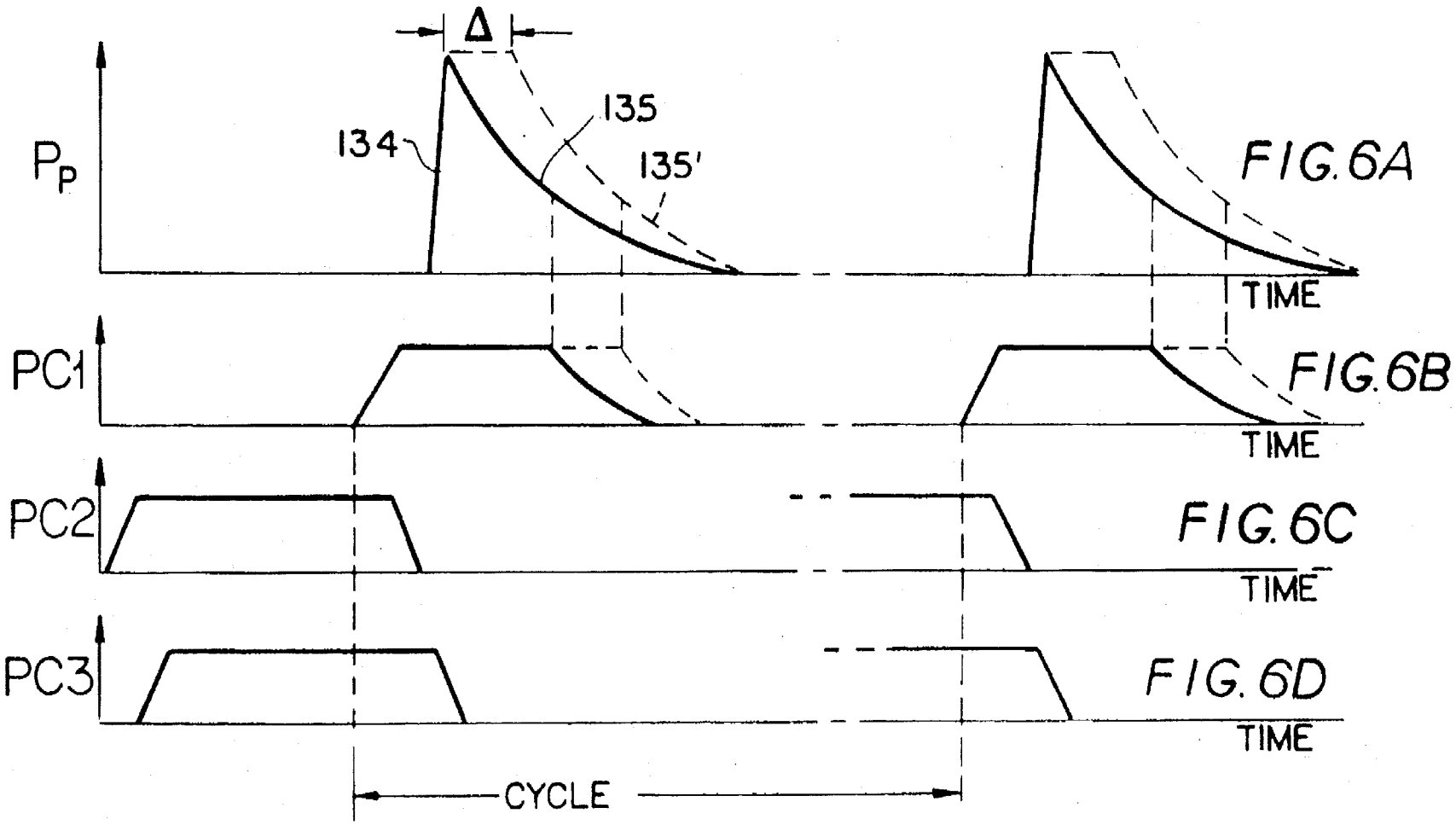
FIG. 6A is a graphical illustration of pressure as a function of time, for foot-pump operation of FIG. 5, as in FIG. 2A.
FIG. 6B is a graphical illustration of pressure as a function of the time scale of FIG. 6A, for tourniquet-cuff operation of FIG. 5, as in FIG. 2B.
FIG. 6C is a graphical illustration of pressure as a function of the time scale of FIG. 6A, for a first-modified tourniquet-cuff operation of FIG. 5.
FIG. 6D is a graphical illustration of pressure as a function of the time scale of FIG. 6A, for a second-modified tourniquet-cuff operation of FIG. 5.

With additional reference to FIG. 6A, the programmed timing of valve (125) opening will be understood to effect relatively rapid inflation of foot-pump 14 via a relatively fast rise 134 to a peak of pressure ($P_p$), followed by a relatively gentle relaxation (135) from peak inflation pressure upon actuation of a venting solenoid 127 (with valve 125 in its NC condition); alternatively, with delayed actuation of the venting solenoid 127 (to the delayed extent Δ), peak inflation pressure can be retained, and the gentle relaxation profile 135' will be correspondingly delayed. The arterial-flow enhancement properties of delayed retention of peak foot-pump inflation pressure are discussed in greater detail in U.S. Pat. No. Re. 32,940.

A concurrent program of cuff-11 inflation and relaxation is controlled by means 130 to supply cuff-inflation pressure fluid from accumulator 121 upon actuation of valve 126, the cuff inflation being shown in FIG. 6B to be retained until relaxation of foot-pump pressure reduces at least to the level of cuff-inflation pressure. The designation PCI is adopted in FIG. 6B, for consideration alongside the foot-pump pressure profile of FIG. 6A, to illustrate use of the control apparatus of FIG. 5 to determine the DVT-reducing mode described in connection with FIGS. 1, 2A and 2B.

Further uses of the control apparatus of FIG. 5 are illustrated by the respective cuff-pressure profiles PC2 and PC3 of FIGS. 6C and 6D, which are particularly helpful in aid of a patient whose leg must be supported in an elevated state that necessarily places his foot, the foot-pump 14 and the cuff 11 above the elevation of his heart, as he lies in bed.

More particularly, in FIG. 6C, which presents the cuff-inflation pressure profile (PC2) to the same time scale as the foot-pump inflation profile ($P_p$) of FIG. 6A, the inflation of cuff 11 occurs for a substantial fraction (e.g., one half) of the full cycle, as an event serving to "prime" the plantar veins immediately prior to foot-pump inflation, so that foot-pump action may have a fuller accumulation of blood in readiness for pumped venous return. In FIG. 6C, the priming is fully completed at the instant of commencing foot-pump inflation, and in FIG. 6D, the profile (PC3) of cuff pressure inflation is seen to lap the foot-pump inflation profile ($P_p$) at least during the rise time of foot-pump inflation. The result of pumped venous-return effectiveness is substantially the same for FIG. 6C and for FIG. 6D, but the venting of cuff pressure is preferred to be substantially complete, as of the initiation of foot-pump inflation.

In the "priming" situations illustrated by FIGS. 6C and 6D, the criteria expressed in the above-noted patents for foot-pump operation are desirable, i.e., with inflation up to 225-mm Hg in less than one second, but the cuff-inflation pressure for "priming" should be in the order of 40 to 50-mm Hg, to allow the patient's heart action to supply the uphill flow for plantar-vein priming purposes. For patient comfort, there is no need for rapid inflation of the cuff, and the reduced slope shown for all cuff inflations in FIGS. 6B, 6C and 6D (compared to the steep slope of FIG. 6A for foot-pump inflation) is a schematic indication of this fact.

In general, it can be said that the peak of foot-pump pressure needed for the DVT treatment situation does not call for such elevated magnitudes as for a situation where DVT is not a problem. In other words, the DVT treatment wherein a thrombolizing agent is injected at the dorsum of the foot is relying upon the cuff to apply tourniquet action on the superficial veins so that deep veins can be more efficiently treated with the thrombolizing agent, in which case a cuff pressure in the order of 50-mm Hg and a peak foot-pump pressure in the range 100 to 200-mm Hg may be sufficient, and with a more gentle rising slope (e.g., to peak foot-pump pressure within 2 seconds or less). On the other hand, for an otherwise healthy leg that must remain elevated above the patient's body, the priming cuff pressure (except for timing) may be substantially the same as for DVT treatment, but with preferably a pressure peak of foot-pump inflation of at least 200-mm Hg.

In methods described herein, and should the physician foresee risk of an embolism, a caval-filter installation is suggested as a preliminary step, for reducing such risk, such installation being in the inferior vena cava as is customary for prospective clot passage with venous flow from a leg.

What is claimed is:

1. The method of treating a leg which is suspended in a raised position above the level of the body of a patient who must lie in bed, which method comprises the following sequence of steps:

(a) transiently applying a first level of tourniquet pressure to the leg solely at a distal-calf location and along no other region of the leg;

(b) retaining the applied tourniquet pressure for a preliminary period of time to enable blood to accumulate in the plantar veins of the leg;

(c) injecting a thrombolytic agent into a vein in the dorsum of the foot;

(d) thereafter applying transient venous-pumping pressure to the plantar region of the leg, wherein the venous-pumping pressure peaks at a level in excess of the retained transient tourniquet pressure;

(e) relieving the retained tourniquet pressure, and thereafter relieving the venous-pumping pressure; and (f) cyclically repeating steps (a) to (e) in a pattern wherein the application of venous-pumping pressure is rapid and wherein the period of cyclical repetition is greater than the combined period of tourniquet-pressure application and of venous-pumping pressure.

2. The method of claim 1, wherein said period for step (b) is up to substantially 10 seconds.

3. The method of claim 1, wherein said period for step (b) is at least 10 seconds prior to step (d).

4. The method of claim 1, wherein the relief of tourniquet pressure is substantially coincident with step (d).

5. The method of claim 1, wherein the rate of applying the tourniquet pressure of step (a) is more slow than the rate of applying the venous-pumping pressure of step (d).

6. The method of claim 1, wherein said period for step (b) is approximately one half of the period of cyclical repetition.

7. The method of claim 1, wherein the relief of venous-pumping pressure is upon achievement of said peak-pressure level.

8. The method of claim 1, wherein said peak-pressure level is maintained for a period up to 5 seconds before relief of venous-pumping pressure.

9. The method of claim 8, wherein the maintenance of said peak-pressure level is for substantially three seconds.

10. The method of claim 1, wherein the period of cyclical repetition is in the range of 15 to 60 seconds.

11. The method of claim 10, wherein said period is substantially 20 seconds.

12. The method of claim 1, wherein a venous-pumping rise to peak pressure is effected within two seconds.

13. The method of claim 12, wherein a venous-pumping rise to peak pressure is effected within 0.5 second or less.

14. The method of claim 1, wherein a tourniquet-pressure rise to said first level is effected within no less than one second.

15. The method of claim 1, wherein said first level of pressure is in the range of 30 to 100-mm Hg.

16. The method of claim 15, wherein said peak-pressure level is in the range up to substantially 225-mm Hg.

17. The method of claim 15, in which said peak-pressure level is at least substantially 200-mm Hg.

18. The method of claim 1, wherein said first level of pressure is in the range of 40 to 60-mm Hg.

19. The method of treating a leg which is suspended in a raised position above the level of the body of a patient who must lie in bed, which method comprises the following sequence of steps:

(a) transiently applying a first level of tourniquet pressure to the leg solely at a distal-calf location and along no other region of the leg;

(b) retaining the applied tourniquet pressure for a preliminary period of time to enable blood to accumulate in the plantar veins of the leg;

(c) thereafter relieving the retained tourniquet pressure and applying transient venous-pumping pressure to the plantar region of the leg, wherein the venous-pumping pressure peaks at a level in excess of the retained tourniquet pressure;

(d) relieving the venous-pumping pressure; and (e) cyclically repeating steps (a) to (d) in a pattern wherein the application of venous-pumping pressure is rapid, wherein the application of tourniquet pressure is slower than said rapid inflation, and wherein the period of cyclical repetition is at least twice said preliminary period.

20. The method of claim 1, comprising a preliminary step of installing a caval filter before performing steps (a) to (e).

21. The method of treating a leg which is suspended in a raised position above the level of the body of a patient who must lie in bed, which method comprises the steps of:

(a) transiently applying a first level of tourniquet pressure to the leg solely at a distal-calf location and along no other region of the leg;

(b) retaining the applied tourniquet pressure for a preliminary period of time to enable blood to accumulate in the plantar veins of the leg;

(c) thereafter applying transient venous-pumping pressure to the plantar region of the leg, wherein the venous-pumping pressure peaks at a level in excess of the retained transient tourniquet pressure;

(d) relieving the tourniquet pressure at substantially the time of transiently applying the venous-pumping pressure; and (e) cyclically repeating steps (a) to (d) in a pattern wherein (i) the application of venous-pumping pressure is rapid, (ii) wherein the period of cyclical repetition is substantially greater than the period of applied venous-pumping pressure, and (iii) wherein a dwell period of relieved pressure is provided, and said dwell period is at least equal to the preliminary period of time, said dwell period being prior to recycled repetition of steps (a) to (d).

22. The method of minimizing development of a DVT region in an afflicted leg, which method comprises the steps of:

(a) transiently applying a first level of tourniquet pressure to the leg solely at a location that is distal to the DVT region and along no other region of the leg;

(b) applying transient venous-pumping pressure to the plantar region of the foot of the leg, wherein the venous-pumping pressure peaks at a level in excess of the transient tourniquet pressure;

(c) relieving the venous-pumping pressure;

(d) maintaining the tourniquet pressure until the venous-pumping pressure has been relieved to substantially the level of tourniquet pressure, and then relieving the tourniquet pressure; and (e) cyclically repeating steps (a) to (d) in a pattern wherein the application of transient venous-pumping pressure is relatively rapid and wherein the period of cyclical repetition is relatively great.

23. The method of minimizing development of a DVT region in an afflicted leg, which method comprises the steps of:

(a) transiently applying a first level of tourniquet pressure to the leg at a location that is distal to the DVT region and along no other region of the leg;

(b) applying transient venous-pumping pressure to the plantar region of the foot of the leg, wherein the venous-pumping pressure peaks at a level in excess of the transient tourniquet pressure;

(c) relieving the venous-pumping pressure;

(d) relieving the tourniquet pressure once the venous-pumping pressure has been relieved to a level below said first level;

(e) cyclically repeating steps (a) to (d) in a pattern wherein the application of transient venous-pumping pressure is relatively rapid and wherein the period of cyclical repetition is relatively great; and (f) injecting a thrombolytic agent into a vein in the dorsum of the foot at least during an interval between steps (a) to (d) of each cycle.

24. The method of minimizing development of a DVT region in an afflicted leg, which method comprises the steps of:

(a) as a preliminary step, installing a caval filter in the inferior vena cava;

(b) transiently applying a first level of tourniquet pressure to the leg solely at a location that is distal to the DVT region and along no other portion of the leg;

(c) applying transient venous-pumping pressure to the plantar region of the foot of the leg, wherein the venous-pumping pressure peaks at a level in excess of the transient tourniquet pressure;

(d) relieving the venous-pumping pressure;

(e) maintaining the tourniquet pressure until the venous-pumping pressure has been relieved to substantially the level of tourniquet pressure and then relieving the tourniquet pressure; and (f) cyclically repeating steps (a) to (e) in a pattern wherein the application of transient venous-pumping pressure is relatively rapid and wherein the period of cyclical repetition is relatively great.

25. The method of using inflatable tourniquet-cuff action applied only to the calf of a leg, wherein such use is in coordinated concurrence with inflatable foot-pump action at the plantar region of the leg, which method comprises the following sequence of steps:

(a) transiently inflating the cuff to a first level of tourniquet-pressure action on superficial veins of the calf and along no other region of the leg;

(b) transiently inflating the foot pump to a peak-pressure level of foot-pump action in excess of said first level;

(c) relieving the foot-pump pressure;

(d) relieving the cuff pressure, said tourniquet-cuff pressure acting for substantially the same amount of time as the foot-pump pressure; and (e) cyclically repeating steps (a) and (d) in a pattern wherein inflation of the foot pump is relatively rapid and wherein the period of cyclical repetition is relatively great.

26. The method of claim 25, in which the relief of foot-pump pressure is upon achievement of said peak-pressure level.

27. The method of claim 25, in which said peak-pressure level is maintained for a period up to 5 seconds before relief of foot-pump pressure.

28. The method of claim 27, in which the maintenance of said peak-pressure level is for substantially three seconds.

29. The method of claim 25, in which the period of cyclical repetition is in the range of 15 to 60 seconds.

30. The method of claim 29, in which said period is substantially 20 seconds.

31. The method of claim 25, in which the rate of inflation of the cuff is slower than the rate of inflation of the foot pump.

32. The method of claim 31, in which foot-pump inflation to peak pressure is effected within one second.

33. The method of claim 31, in which foot-pump inflation to peak pressure is effected within 0.5 second or less.

34. The method of claim 33, in which cuff inflation to said first level is effected within no less than one second.

35. The method of claim 25, comprising a preliminary step of installing a caval filter before performing steps (a) to (e).

36. The method of claim 25, in which said first level of pressure is in the range of 30 to 100-mm Hg.

37. The method of claim 36, in which said peak-pressure level is in the range up to substantially 225-mm Hg.

38. The method of claim 36, in which said peak-pressure level is at least substantially 200-mm Hg.

39. The method of claim 25, in which said first level of pressure is in the range of 40 to 60-mm Hg.

40. The method of prophylactically or therapeutically treating a leg for a known or potential DVT condition, which method comprises the following sequence of steps:

(a) transiently applying a first level of tourniquet pressure to the leg solely at a distal-calf location and along no other region of the leg;

(b) applying transient venous-pumping pressure to the plantar region of the leg, wherein the venous-pumping pressure peaks at a level in excess of the transient tourniquet pressure;

(c) relieving the venous-pumping pressure; said tourniquet pressure acting for substantially the same amount of time as the venous-pumping pressure at the plantar region of the leg;

(d) relieving the tourniquet pressure; and (e) cyclically repeating steps (a) to (d) in a pattern wherein the application of transient venous-pumping pressure is relatively rapid and wherein the period of cyclical repetition is relatively great.

41. The method of claim 40, wherein said first level is varied in the course of a given treatment involving multiple cycles.

42. The method of claim 40, wherein the peak level of step (b) is varied in the course of a given treatment involving multiple cycles.

43. The method of claim 40, wherein step (a) is concurrently also applied proximally to the distal-calf location.

44. The method of treating a leg which is suspended in a raised position above the level of the body of a patient who must lie in bed, which method comprises the steps of:

(a) transiently applying a first level of tourniquet pressure to the leg solely at a distal-calf location and along no other region of the leg;

(b) retaining the applied tourniquet pressure for a period of time to enable blood to accumulate in the plantar veins of the leg;

(c) thereafter applying transient venous-pumping pressure to the plantar region of the leg, wherein the venous-pumping pressure peaks at a level in excess of the retained transient tourniquet pressure;

(d) relieving the venous-pumping pressure and the retained tourniquet pressure, said tourniquet pressure acting not only for said preliminary period of time but also for substantially the same amount of time as the venous-pumping pressure; and (e) cyclically repeating steps (a) to (d) in a pattern wherein (i) the application of venous-pumping pressure is relatively rapid, (ii) wherein the period of cyclical repetition is relatively great, and (iii) wherein a dwell period of relieved pressure is provided, and said dwell period is at least equal to the preliminary period of time, said dwell period being prior to recycled repetition of steps (a) to (d).

45. The method of claim 44, wherein the period of time for step (b) is relatively long.

46. The method of claim 44, wherein said period for step (b) is up to substantially 10 seconds.

47. The method of claim 44, wherein said period for step (b) is at least 10 seconds prior to step (c).

48. The method of claim 44, wherein said period for step (b) is approximately one half of the period of cyclical repetition.

49. The method of stimulating venous-return flow in a human leg while preferentially enhancing such flow in deep veins of the leg, with concomitant restriction of such flow in superficial veins of the leg, which method comprises the steps of:

(a) transiently applying a first level of tourniquet pressure to a calf region of the leg and along no other region of the leg;

(b) applying transient venous-pumping pressure to the plantar region of the foot of the leg, wherein the venous-pumping pressure peaks at a level in excess of the transient tourniquet pressure;

(c) relieving the venous-pumping pressure;

(d) relieving the tourniquet pressure once the venous-pumping pressure has been relieved to a level below said first level;

(e) cyclically repeating steps (a) to (d) in a pattern wherein the application of transient venous-pumping pressure is relatively rapid and wherein the period of cyclical repetition is relatively great; and (f) injecting the thrombolytic agent into a vein in the dorsum of the foot at least during an interval between step (d) of one cycle and step (a) of the next succeeding cycle.

50. The method of stimulating venous-return flow in a human leg while preferentially enhancing such flow in deep veins of the leg, with the concomitant restriction of such flow in superficial veins of the leg, which method comprises the steps of:

(a) transiently applying a first level of tourniquet pressure solely to a calf region of the leg and along no other region of the leg;

(b) applying transient venous-pumping pressure to the plantar region of the foot of the leg, wherein the venous-pumping pressure peaks at a level in excess of the transient tourniquet pressure;

(c) relieving the venous-pumping pressure;

(d) relieving the tourniquet pressure once the venous-pumping pressure has been relieved to a level below said first level, the tourniquet pressure acting for substantially the same amount of time as the venous-pumping pressure at the plantar region of the foot; and (e) cyclically repeating steps (a) to (d) in a pattern wherein the application of transient venous-pumping pressure is relatively rapid and wherein the period of cyclical repetition is relatively great.

51. The method of claim 50, comprising a preliminary step of installing a caval filter before performing steps (a) to (e).

52. The method of claim 50, wherein steps (a) and (b) are preceded by:

(a') selection of an inflatable tourniquet cuff and application of the cuff to the calf region, and (b') selection of an inflatable foot pump and application of the foot pump to the plantar region; and wherein thereafter:

step (a) is a transient inflation of the cuff to a first level of tourniquet-pressure action; and step (b) is a transient inflation of the foot pump, to a peak-pressure level in excess of said first level.

53. The method of claim 50, in application to a prophylactic or a therapeutic treatment of a leg, wherein step (a) is applied at a distal-calf location.

54. The method of claim 50, in treatment of a leg which is suspended in a raised position above the level of the body of a patient who must lie in bed, wherein step (a) is applied at a distal-calf location and for a preliminary period of time sufficient for blood to accumulate in the plantar veins of the leg.

55. The method of treating a traumatized region of a human leg wherein the trauma exists at a location proximal to the distal calf, said method comprising the steps of applying inflatable tourniquet-cuff action only to the distal calf and in a coordinated program of inflatable foot-pump action at the plantar region of the leg, said program comprising the steps of:

(a) transiently inflating the cuff to a first level of tourniquet-pressure action on superficial veins of the distal calf;

(b) transiently inflating the foot-pump to a peak-pressure level of foot-pump action in excess of said first level;

(c) relieving the foot-pump pressure;

(d) relieving the cuff pressure;

(e) cyclically repeating steps (a) to (d) in a pattern wherein inflation of the foot-pump is relatively rapid and wherein the period of cyclical repetition is relatively great; and (f) injecting a thrombolytic agent into a vein in the foot at least during an interval between step (d) of one cycle and step (a) of the next succeeding cycle.

* * * * *

UNITED STATES PATENT AND TRADEMARK OFFICE

CERTIFICATE OF CORRECTION

PATENT NO. : 5,669,872
DATED : September 23, 1997
INVENTOR(S) : Roger Harrington Fox

It is certified that error appears in the above-identified patent and that said Letters Patent is hereby corrected as shown below:

On the front page, following INID Code [54]:

"METHOD FOR FOCUSED DELIVERY OF VENOUS FLOW FOR ARTIFICIAL IMPLUSE COMPRESSION OF AN ANATOMICAL FOOT PUMP"

Change the title, located at INID Code [54] to read as follows:

--METHOD FOR FOCUSED DELIVERY OF VENOUS FLOW FOR ARTIFICIAL IMPULSE COMPRESSION OF AN ANATOMICAL FOOT PUMP --

Signed and Sealed this

Fifteenth Day of May, 2001

*Attest:*

Nicholas P. Godici

NICHOLAS P. GODICI

*Attesting Officer*

*Acting Director of the United States Patent and Trademark Office*